US008491340B2

(12) United States Patent
Sass et al.

(10) Patent No.: US 8,491,340 B2
(45) Date of Patent: Jul. 23, 2013

(54) EDGE CONNECTOR THAT ACCOMMODATES PRINTED CIRCUIT BOARDS OF VARYING THICKNESS

(75) Inventors: Tony C. Sass, Fuquay Varina, NC (US); Paul A. Wormsbecher, Apex, NC (US)

(73) Assignee: International Business Machines Corporation, Armonk, NY (US)

( * ) Notice: Subject to any disclaimer, the term of this patent is extended or adjusted under 35 U.S.C. 154(b) by 167 days.

(21) Appl. No.: 13/031,759

(22) Filed: Feb. 22, 2011

(65) Prior Publication Data

US 2012/0214347 A1 Aug. 23, 2012

(51) Int. Cl.
*H01R 24/00* (2011.01)

(52) U.S. Cl.
USPC ..... 439/636; 439/65

(58) Field of Classification Search
USPC ..... 439/630, 629, 631, 632, 636, 59, 439/62
See application file for complete search history.

(56) References Cited

U.S. PATENT DOCUMENTS 3,027,538 A * 3/1962 Deakin ..... 439/629
3,137,537 A * 6/1964 Cole et al. ..... 439/493
4,129,351 A * 12/1978 Sugimoto et al. ..... 439/325
5,679,018 A 10/1997 Lopata et al.
5,913,699 A 6/1999 Zielke
6,012,928 A 1/2000 Lopata et al.
6,036,519 A 3/2000 Lopata et al.
6,095,821 A 8/2000 Panella et al.
6,790,054 B1 9/2004 Boonsue
6,976,879 B2 12/2005 Shishikura et al.
7,192,287 B2 3/2007 Kikuchi et al.
7,497,713 B1 3/2009 Huettner et al.
2012/0083158 A1* 4/2012 Funamura et al. ..... 439/607.31
2012/0129362 A1* 5/2012 Hampo et al. ..... 439/65
2012/0225588 A1* 9/2012 Westman et al. ..... 439/636

* cited by examiner

*Primary Examiner* — Hae Moon Hyeon
(74) *Attorney, Agent, or Firm* — H. Barrett Spraggins; Cynthia G. Seal; Biggers & Ohanian, LLP

(57) ABSTRACT

An edge connector is provided that accommodates printed circuit boards (PCB) of varying thickness. Embodiments include a body; a set of card connector engagement pins coupled to the body, the set of card connector engagement pins coupling with a circuit card connector; and the set of PCB engagement pins coupled to the body, the set of PCB engagement pins receiving contact pads of the PCB, wherein each PCB engagement pin includes a contact point that slopes away from the body of the edge connector, wherein the contact point of each PCB engagement pin slopes in an opposite direction from the contact point of the other PCB engagement pin in the set, wherein each PCB engagement pin is flexible inward toward the body of the edge connector.

13 Claims, 10 Drawing Sheets

EDGE CONNECTOR THAT ACCOMMODATES PRINTED CIRCUIT BOARDS OF VARYING THICKNESS

BACKGROUND OF THE INVENTION

1. Field of the Invention

The field of the invention is data processing, or, more specifically, edge connectors, circuit card connectors, and methods of attaching an edge connector that accommodates printed circuit boards of varying thickness.

2. Description of Related Art

A printed circuit board (PCB) supports the interconnection of electrical components. The functionality of PCBs may be expanded by attached a circuit card to the PCB. A circuit card connector may be used to mount the circuit card to the PCB. However, the size and location of the mounting surface of a PCB may vary from PCB to PCB.

SUMMARY OF THE INVENTION

An edge connector is provided that accommodates printed circuit boards (PCB) of varying thickness. Embodiments include a body; a set of card connector engagement pins coupled to the body, the set of card connector engagement pins coupling with a circuit card connector; and the set of PCB engagement pins coupled to the body, the set of PCB engagement pins receiving contact pads of the PCB, wherein each PCB engagement pin includes a contact point that slopes away from the body of the edge connector, wherein the contact point of each PCB engagement pin slopes in an opposite direction from the contact point of the other PCB engagement pin in the set, wherein each PCB engagement pin is flexible inward toward the body of the edge connector.

A circuit card connector that includes an edge connector that accommodates printed circuit boards (PCB) of varying thickness. Embodiments include the edge connector comprising a body; a set of card connector engagement pins coupled to the body, the set of card connector engagement pins coupling with a circuit card connector; and the set of PCB engagement pins coupled to the body, the set of PCB engagement pins receiving contact pads of the PCB, wherein each PCB engagement pin includes a contact point that slopes away from the body of the edge connector, wherein the contact point of each PCB engagement pin slopes in an opposite direction from the contact point of the other PCB engagement pin in the set, wherein each PCB engagement pin is flexible inward toward the body of the edge connector.

A method is provided of attaching a circuit card connector using an edge connector that accommodates printed circuit boards of varying thickness. Embodiments include providing an edge connector that includes a body; a set of circuit card engagement pins coupled to the body; a set of PCB engagement pins, the set of circuit card engagement pins coupling with a circuit card connector; the set of PCB engagement pins receiving contact pads of the PCB, wherein each PCB engagement pin includes a contact point that slopes away from the body of the edge connector, wherein the contact point of each PCB engagement pin slopes in an opposite direction from the contact point of the other PCB engagement pin in the set, wherein each PCB engagement pin is flexible inward toward the body of the edge connector; coupling the edge connector to the circuit card connector; and inserting the set of PCB engagement pins between contact pads of the PCB such that the contact points of the PCB engagement pins contacts the contact pads of the PCB.

The foregoing and other objects, features and advantages of the invention will be apparent from the following more particular descriptions of exemplary embodiments of the invention as illustrated in the accompanying drawings wherein like reference numbers generally represent like parts of exemplary embodiments of the invention.

DETAILED DESCRIPTION OF EXEMPLARY EMBODIMENTS

Figure 1A:
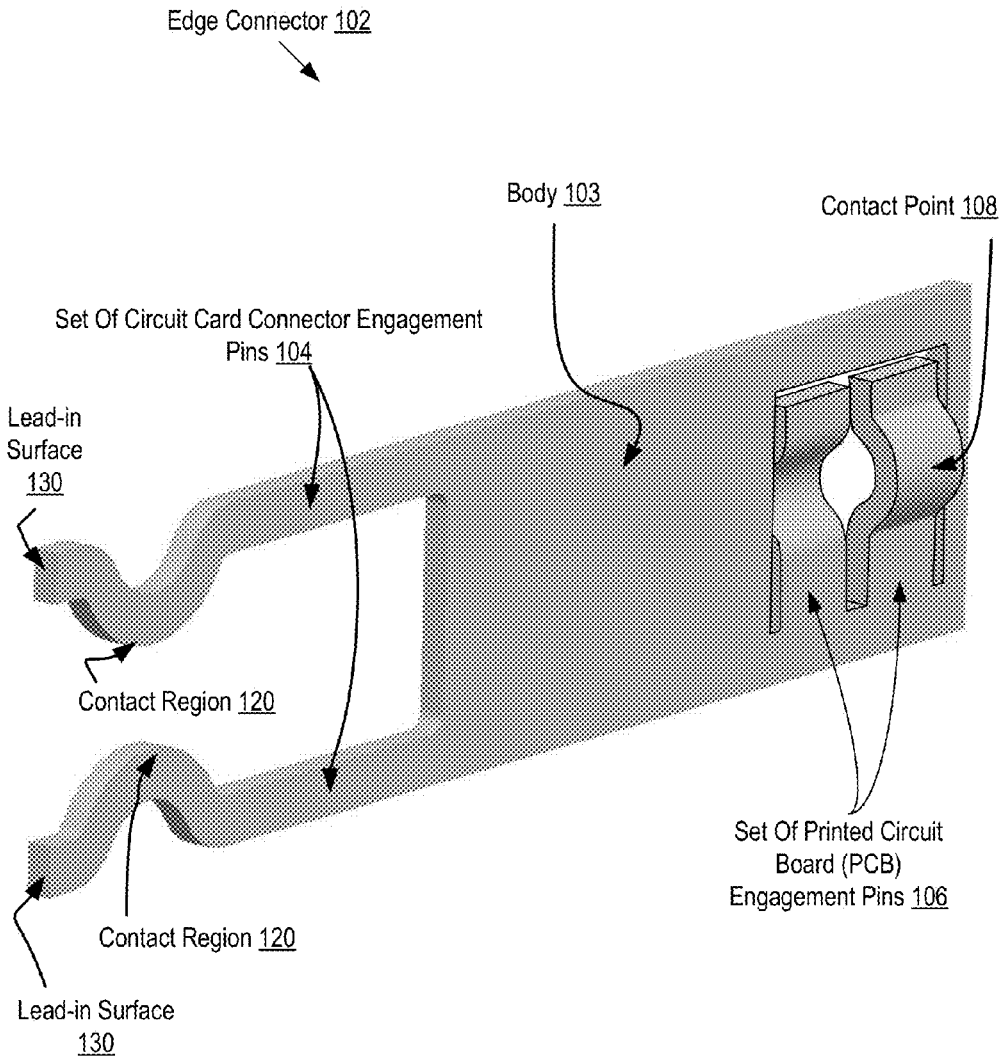
FIG. 1A sets forth a diagram of an edge connector that accommodates printed circuit boards of varying thickness according to embodiments of the present invention.

FIG. 1A sets forth a diagram of an edge connector that accommodates printed circuit boards (PCB) of varying thickness according to embodiments of the present invention. The edge connector (102) of FIG. 1A is used to mount a circuit card connector to an edge of a PCB, for example a computer motherboard. A circuit card connector provides circuit paths so that power, ground, and digital signals can be transferred between a circuit card (not shown), for example a power supply, to contact pads of a PCB (not shown).

The edge connector (102) of FIG. 1A includes a body (103), a set of circuit card connector engagement pins (104), and a set of PCB engagement pins (106). The set of circuit card connector engagement pins (104) and the set of PCB engagement pins (106), each coupled to the body. Coupling the set of circuit card connector engagement pins (104) and the set of PCB engagement pins (106) to the body (103) of the edge connector (120) may include the body (103), the set of circuit card connector engagement pins (104), and the set of PCB engagement pins (106) comprising a single piece or one or more components.

The set of circuit card connector engagement pins (104) are for coupling with a circuit card connector. In the example of FIG. 1A, each circuit card engagement pin includes a lead-in surface (130) and a contact region (120). The lead-in surface (130) is used for coupling a circuit card engagement pin with a circuit card connector, and the contact region (120) establishes a point of contact in a conductive pathway between the edge connector (102) and a circuit card connector. Each contact region (120) of FIG. 1A slopes inwards towards the contact region of the other circuit card engagement pin in the set (104). When the edge connector (102) is inserted into a circuit card connector, the set of circuit card engagement pins (104) of the edge connector (102) enters into the circuit card connector and the lead-in surfaces engage a surface within the circuit card connector. Engagement with the lead-in surfaces causes the set of circuit card engagement pins (104) to resiliently deflect or separate. When the edge connector (102) is fully inserted into the circuit card connector, the set of circuit card engagement pins (104) engage a conductive region within the circuit card connector and a conductive pathway is established between the edge connector (102) and the circuit card connector.

On the end of the edge connector (102) that is opposite the set of circuit card engagement pins (104), the set of PCB engagement pins (106) are for establishing a conductive pathway with a PCB. Similar to the circuit card engagement pins (104), each PCB engagement pin includes a contact point (108) that slopes away from the edge connector (102). The contact point of each PCB engagement pin slopes in an opposite direction from the contact point of the other PCB engagement pin in the set (106). In the example of FIG. 1A, the direction of slope of the contact points of the set of PCB engagement pins (106) is substantially perpendicular to the direction of slope of the contact region of the set of circuit card engagement pins (104).

When the edge connector (102) is inserted into an edge connector insertion cavity of a PCB, the set of PCB engagement pins flex to accommodate the particular size of the edge connector insertion cavity of the PCB. That is, each PCB engagement pin is flexible inward toward the edge connector (102). As the set of PCB engagement pins (106) flex inward and move closer to the edge connector (102), the width between the contact points of the set of PCB engagement pins (104) is reduced. The amount that the set of PCB engagement pins (106) flex inward may be set to accommodate PCBs of varying thicknesses. An edge connector that accommodates PCBs of varying thicknesses enables the edge connector to be used on a variety of PCBs without having to be retooled.

Figure 1B:
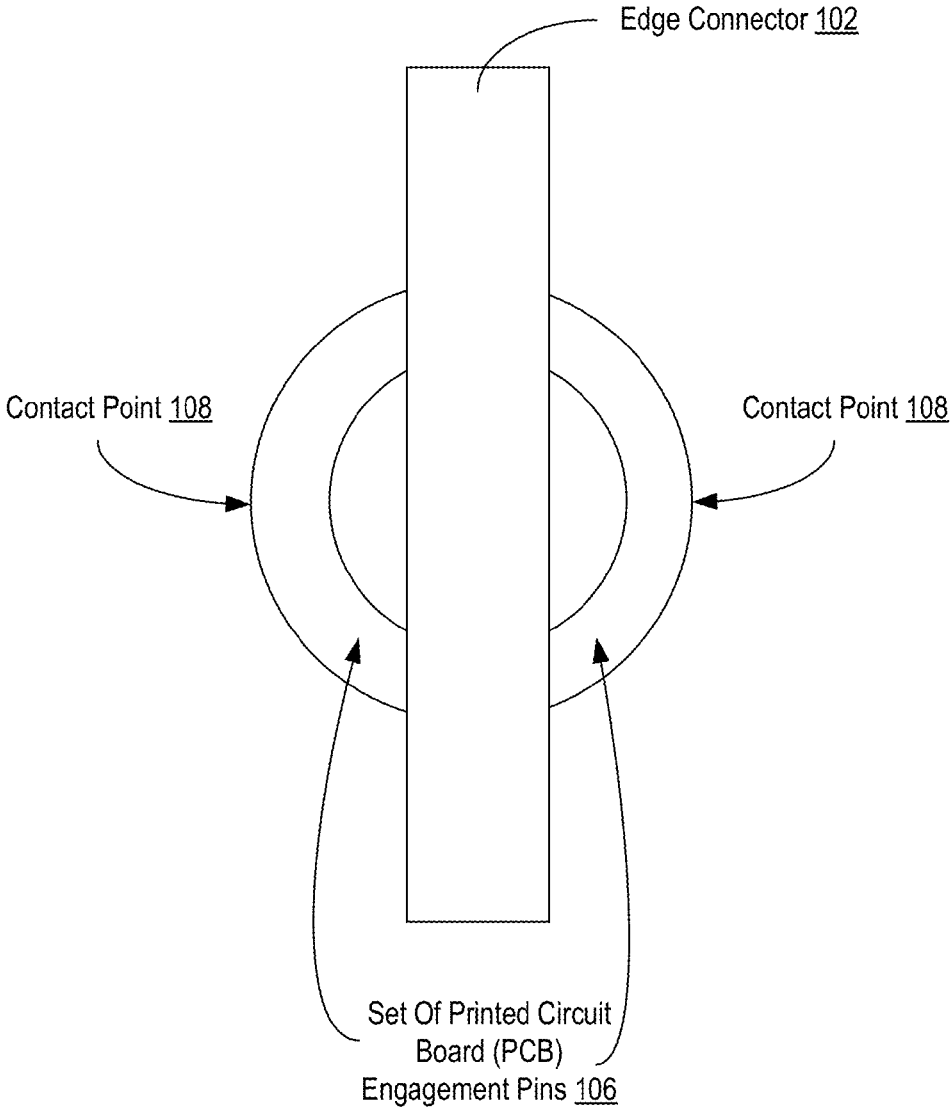
FIG. 1B sets forth a diagram of an alternative view of the edge connector of FIG. 1A that accommodates printed circuit boards of varying thickness according to embodiments of the present invention.

FIG. 1B sets forth a diagram of an alternative view of the edge connector of FIG. 1A that accommodates printed circuit boards (PCB) of varying thickness according to embodiments of the present invention. In FIG. 1B, a side sectional view of the set of printed circuit board (PCB) engagement pins (106) is illustrated. As shown in FIG. 1B, the contact point (108) of each PCB engagement pin extends outward from the edge connector (102). When the edge connector (102) is inserted into an edge connector insertion cavity of a PCB (not shown), contact pads within the edge connector insertion cavity may press against the contact points of the set of PCB engagement pins (106). If the edge connector insertion cavity of the PCB is smaller than the distance between the contact points of the set of PCB engagement pins (106), the set of PCB engagement pins (106) may flex inward toward the edge connector (102), thus enabling the edge connector (102) to accommodate a PCB of varying thickness.

Figure 2:
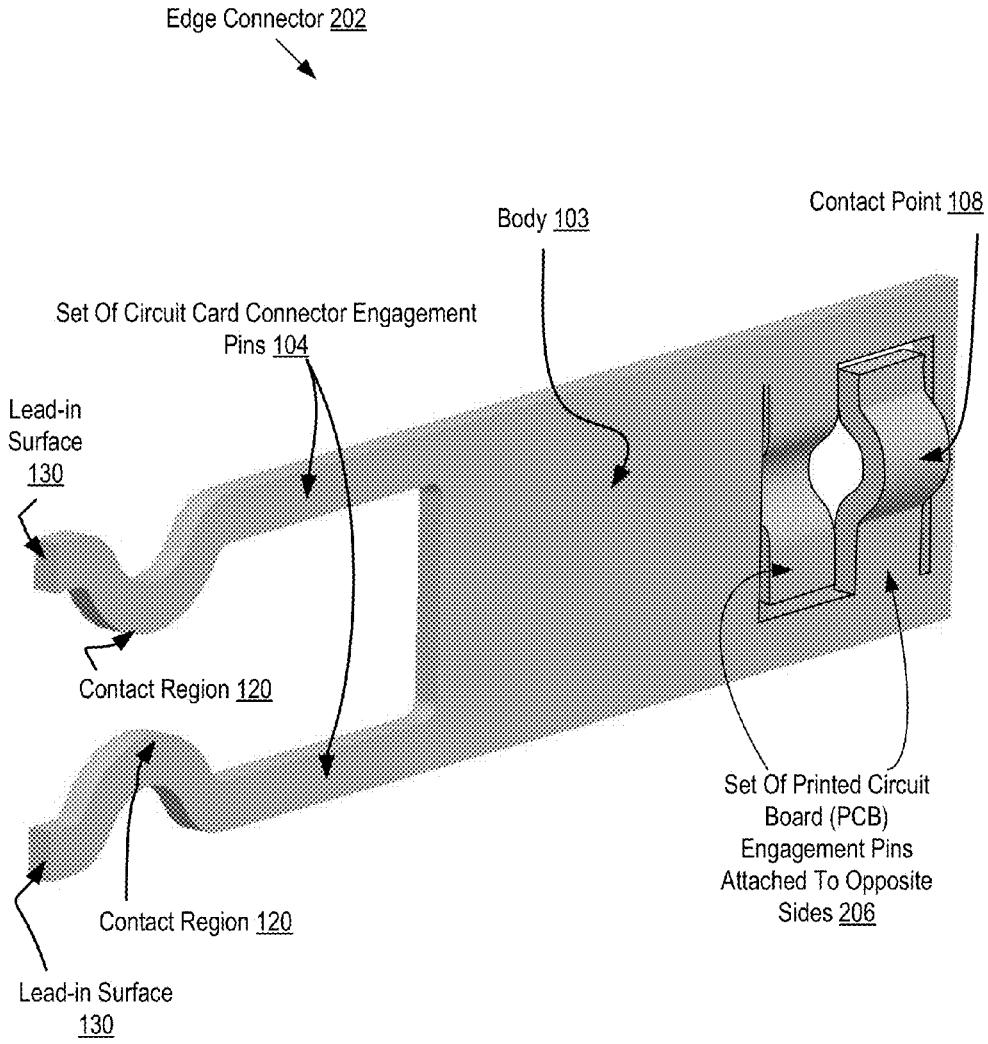
FIG. 2 sets forth a diagram of another edge connector that accommodates printed circuit boards of varying thickness according to embodiments of the present invention.

FIG. 2 sets forth a diagram of another edge connector that accommodates printed circuit boards of varying thickness according to embodiments of the present invention. The edge connector (202) of FIG. 2 is similar to the edge connector (102) of FIG. 1A in that it includes a body (103); a set of circuit card connector engagement pins (104), each of which includes a lead-in surface (130) and a contact region (120). In the example of FIG. 2, however, the edge connector (202) includes a set of PCB engagement pins (206) that are attached to opposite sides of the body of the edge connector (202) in contrast to the edge connector (102) of FIG. 1A, in which the set of PCB engagement pins (106) are attached to the same side of the body of the edge connector (102).

Figure 3:
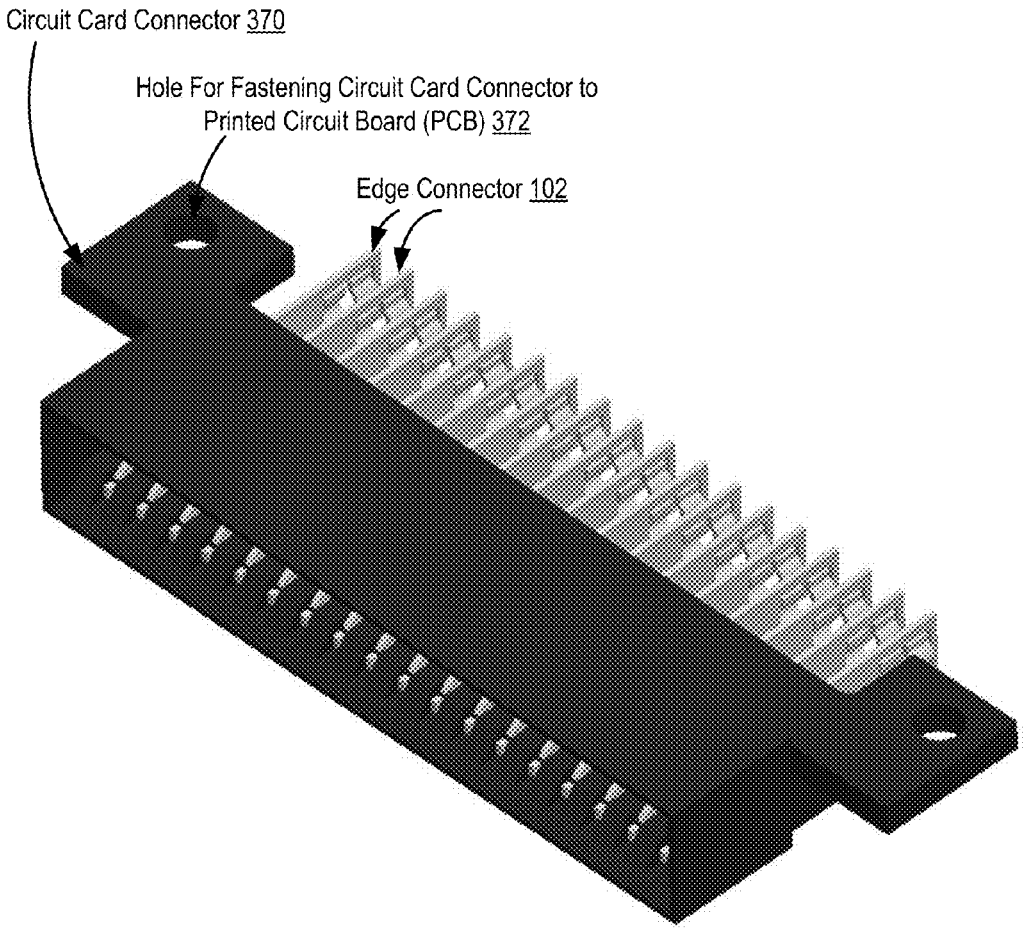
FIG. 3 sets forth a diagram of a circuit card connector that includes an edge connector that accommodates printed circuit boards of varying thickness according to embodiments of the present invention.

FIG. 3 sets forth a diagram of a circuit card connector (370) that includes an edge connector (102) that accommodates printed circuit boards of varying thickness according to embodiments of the present invention. The edge connectors are connected to the circuit card connector (370) and provide a mechanism to establish a conductive pathway for transferring electrical signals from a circuit card to a PCB. A circuit card connector may include conductive traces that provide power, ground, and signal paths from a circuit card to an edge connector. The edge connectors (102) establish conductive pathways from the circuit card connector (370) to the PCB. To secure the circuit card connector (370) to the PCB, the circuit card connector (370) also includes a hole (372) on each side of the circuit card connector (370). A screw or other type of fastening device may be threaded through the hole (372) for fastening the circuit card connector (102) to a PCB.

Figure 4:
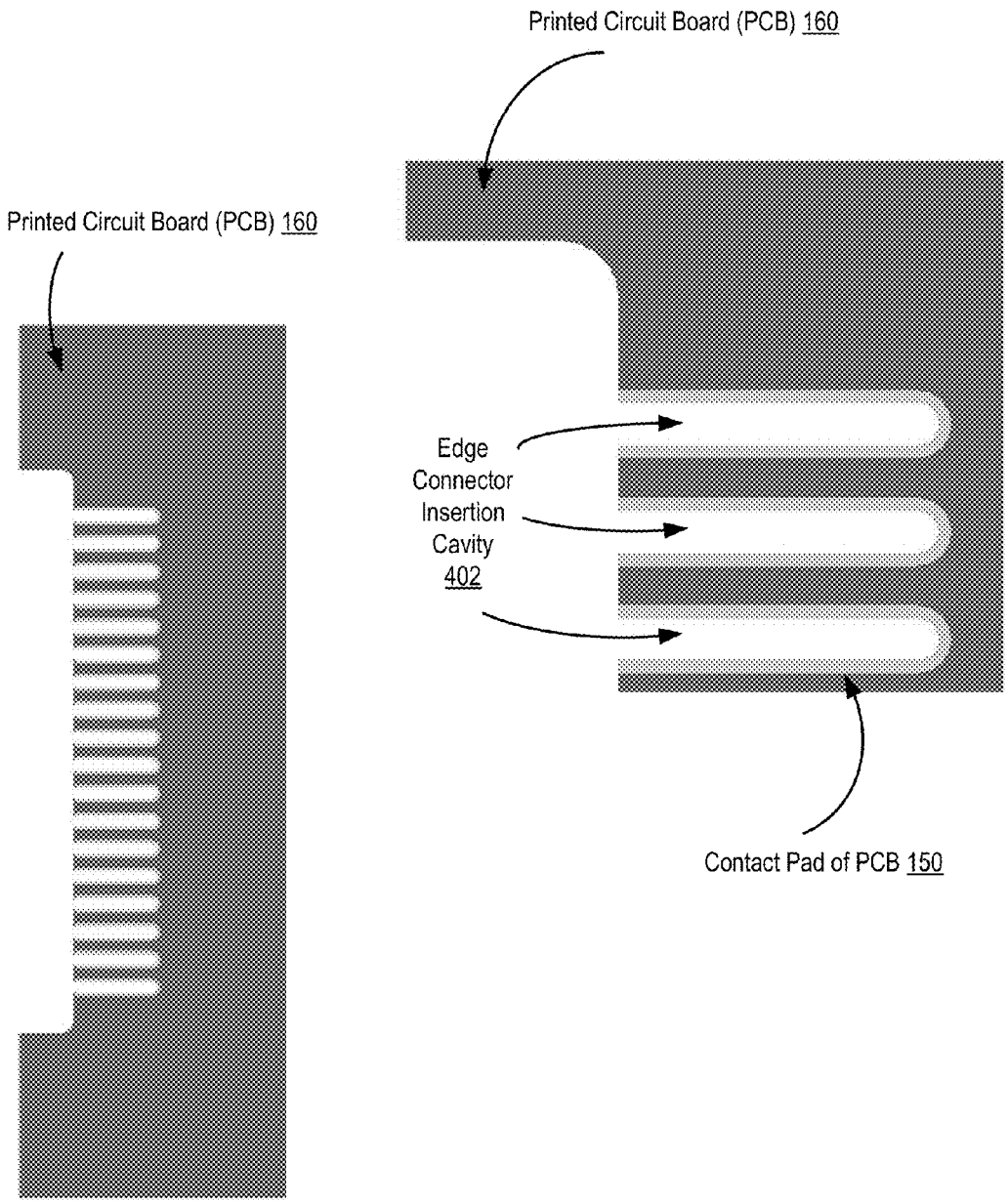
FIG. 4 sets forth a diagram of a printed circuit board that can be accommodated by an edge connector according to embodiments of the present invention.

FIG. 4 sets forth a diagram of a printed circuit board (PCB) (160) that can be accommodated by an edge connector according to embodiments of the present invention. A printed circuit board is used to mechanically support and electronically connect electronic components using conductive pathways, tracks, or signal traces etched from copper sheets laminated onto a non-conductive substrate. The PCB (160) of FIG. 4 may include conductive pathways (not show) that couple electrical components (not shown) that are mounted on the PCB to a contact pad (150).

The contact pad (150) of the PCB (160) of FIG. 4 is part of an edge connector insertion cavity (402) used for establishing a conductive pathway between an edge connector and the electrical components of the PCB (160). The edge connector insertion cavity (402) of FIG. 4 is formed along the edge of the PCB (160). To form an edge of the PCB (160) that includes contact pads, post plate edge routing may be used. Post plate edge routing may include drilling a hole through the PCB (160) and then plating the hole. After the hole is plated, the edge of the PCB (160) may be cut such that the hole is opened, forming the edge connector insertion cavity (402).

Figure 5:
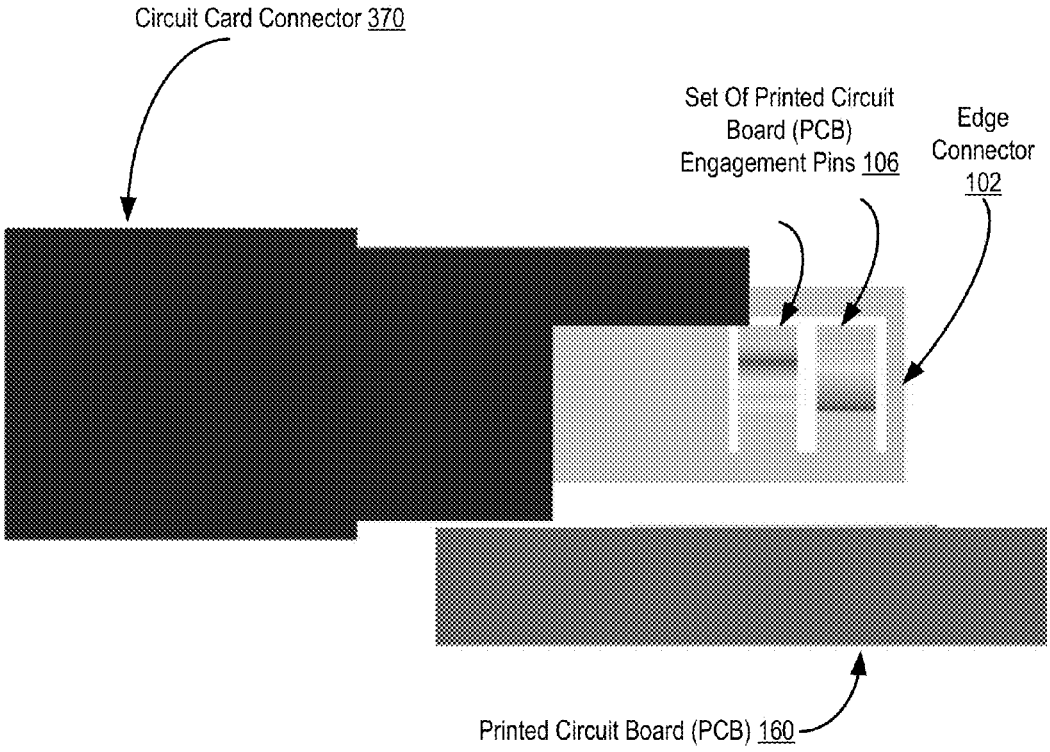
FIG. 5 sets forth a diagram of an apparatus that includes an edge connector that accommodates printed circuit boards of varying thickness according to embodiments of the present invention.

FIG. 5 sets forth a diagram of an apparatus that includes an edge connector (102) that accommodates printed circuit boards (PCB) (160) of varying thickness according to embodiments of the present invention. FIG. 5 illustrates a side sectional view of a pre-assembly configuration of the edge connector (102) of FIG. 1A, the circuit card connector (370) of FIG. 3, and the PCB (160) of FIG. 4. In the example of FIG. 5, the edge connector (102) is inserted into the circuit card connector (370) and aligned for insertion within the edge connector insertion cavity (not shown) of the PCB (160). When the edge connector (102) is fully inserted into the edge connector insertion cavity of the PCB (160), the set of PCB engagement pins (106) will flex inwards or outwards to accommodate the thickness of the edge connector cavity of the PCB (160).

Figure 6A:
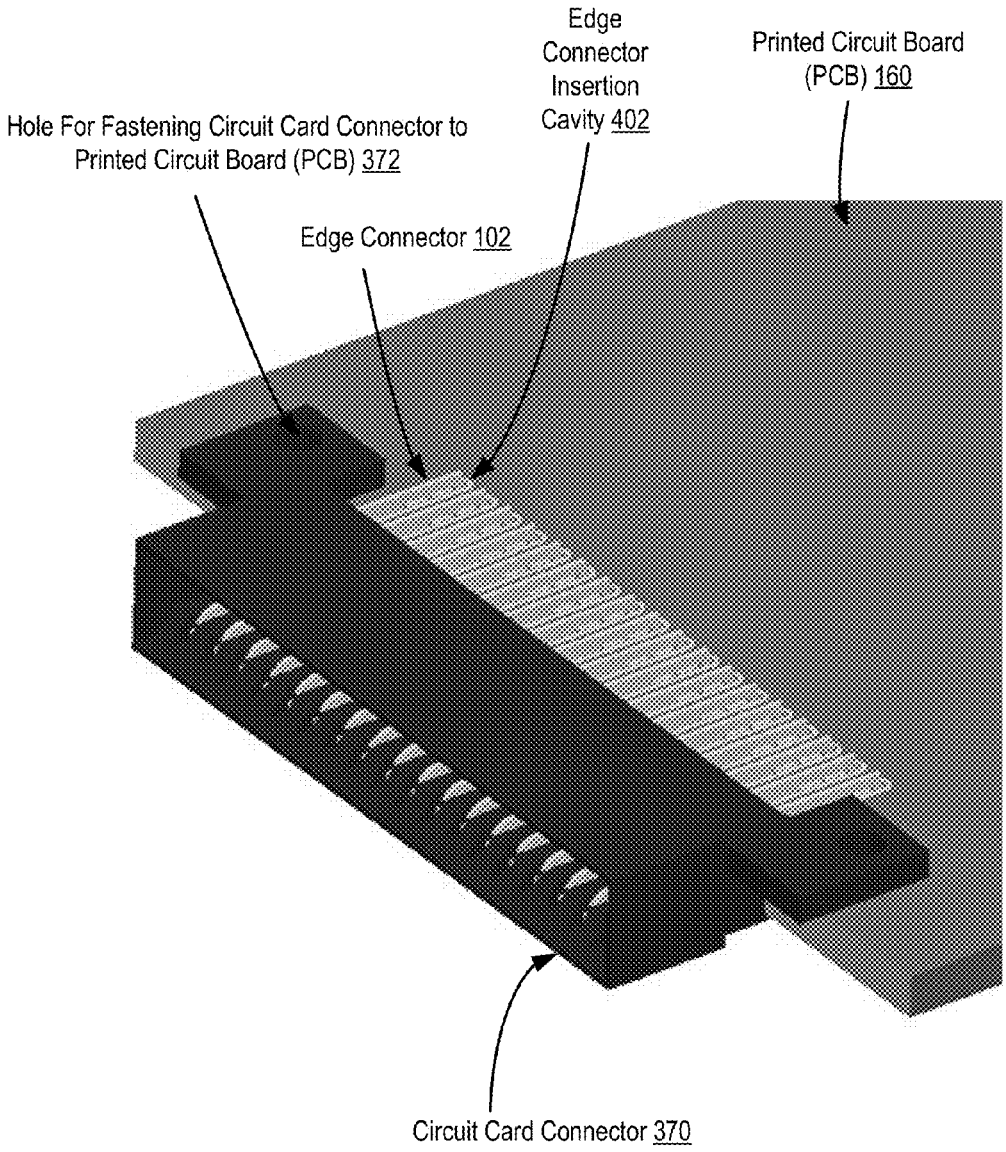
FIG. 6A sets forth a diagram of another apparatus that includes an edge connector that accommodates printed circuit boards of varying thickness according to embodiments of the present invention.

FIG. 6A sets forth a diagram of another apparatus that includes an edge connector (102) that accommodates printed circuit boards (PCB) (160) of varying thickness according to embodiments of the present invention. The apparatus of FIG. 6A illustrates a view of a post-assembly configuration of the edge connector (102) of FIG. 1A, the circuit card connector (370) of FIG. 3, and the PCB (160) of FIG. 4. In the example of FIG. 6A, the edge connector (102) is fully inserted into the edge connector insertion cavity. When the edge connector (102) is inserted between the pads of the PCB (160), the set of PCB engagement pins (106) press against the pads of the PCB (160). The circuit card connector (370) may be coupled to the PCB (160) by fastening screws through the hole (372) in the circuit card connector (372) and into the PCB (160).

Figure 6B:
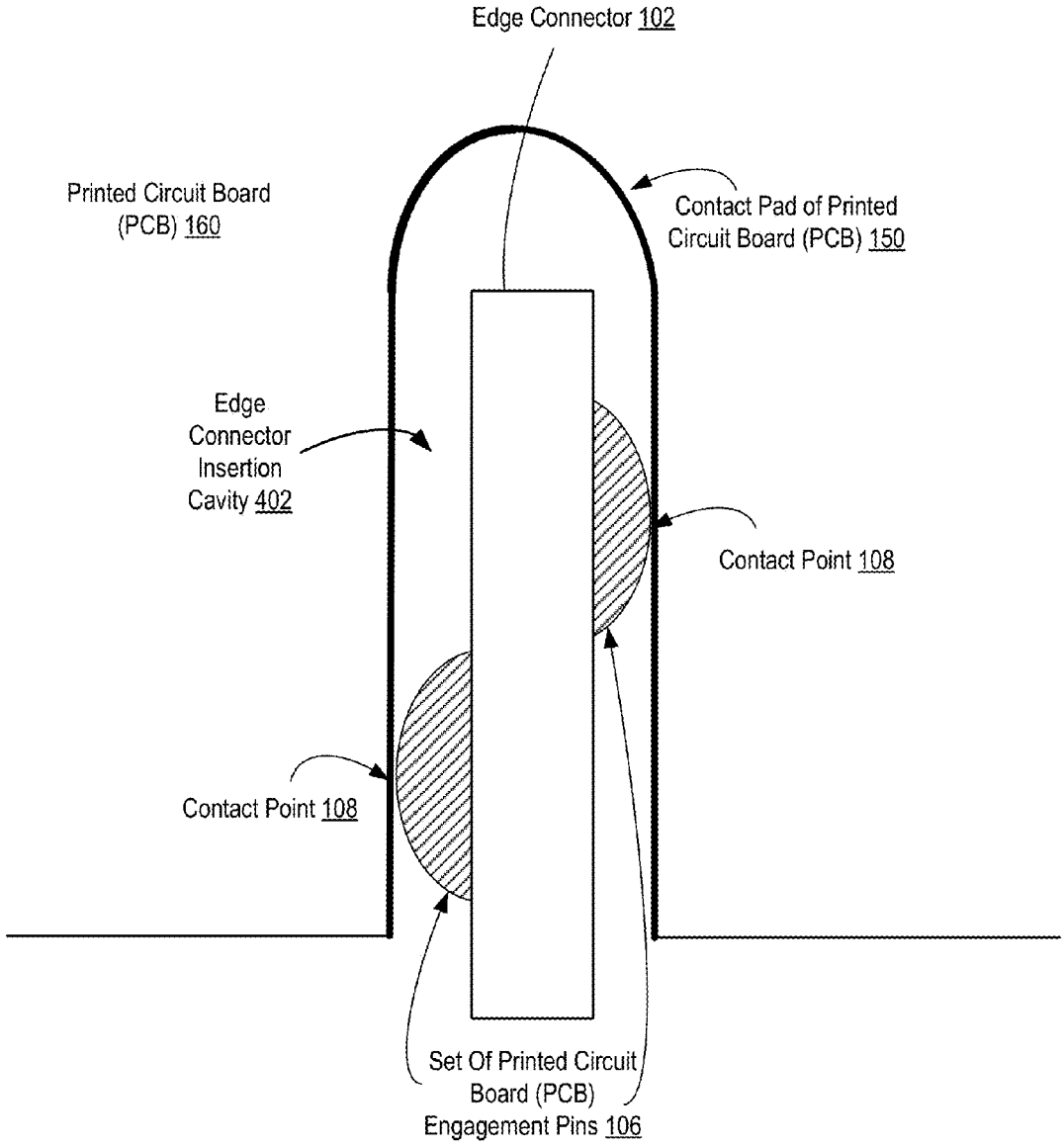
FIG. 6B sets forth a diagram of an alternative view of the apparatus of FIG. 6A that accommodates printed circuit boards of varying thickness according to embodiments of the present invention.

FIG. 6B sets forth a diagram of an alternative view of the apparatus of FIG. 6A that accommodates printed circuit boards of varying thickness according to embodiments of the present invention. In the alternative view of the post-assembly configuration of FIG. 6A, the edge connector (102) is fully inserted into the edge connector insertion cavity (402). The contact points (108) of the set of PCB engagement pins (106) are pressed against the contact pad (150) that lines the edge connection insertion cavity (402) of the PCB (160).

Figure 7:
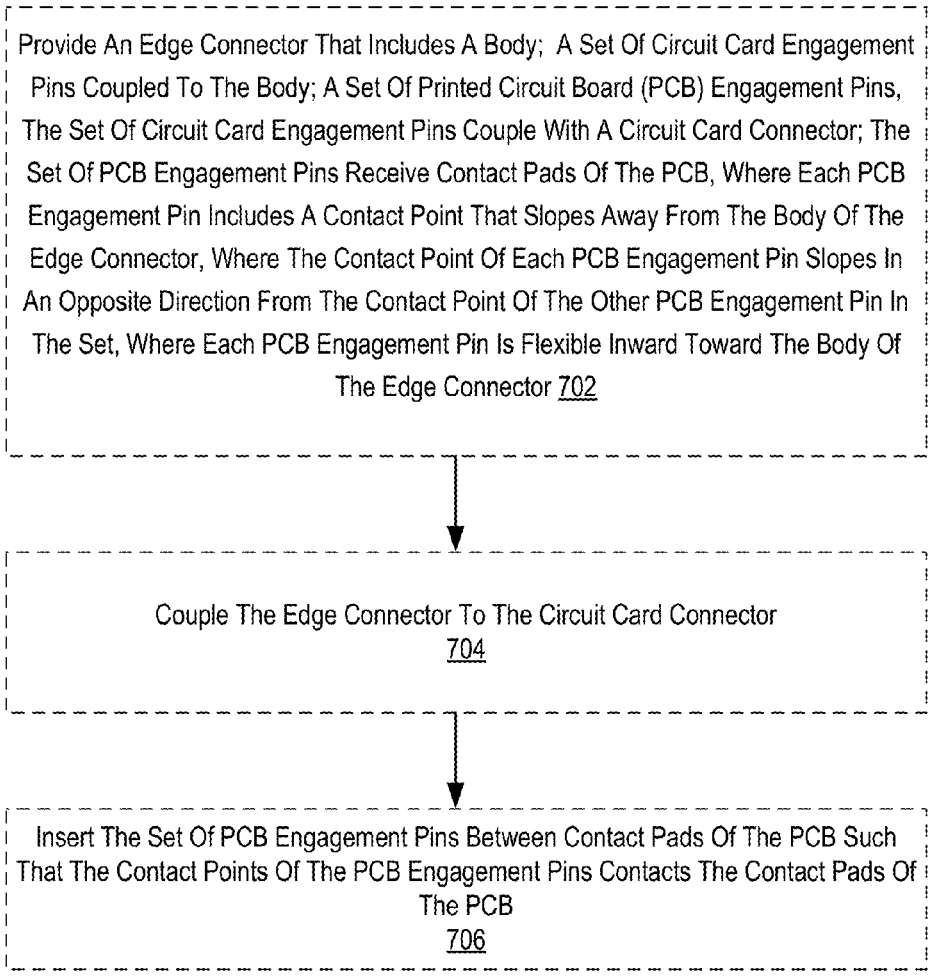
FIG. 7 sets forth a flow chart illustrating an exemplary method of attaching a circuit card connector to a printed circuit board using an edge connector that accommodates printed circuit boards of varying thickness according to embodiments of the present invention.

FIG. 7 sets forth a flow chart illustrating an exemplary method of attaching a circuit card connector using an edge connector that accommodates printed circuit boards of varying thickness according to embodiments of the present invention. The method of FIG. 7 includes providing (702) an edge connector that includes a body; a set of circuit card engagement pins coupled to the body; a set of PCB engagement pins coupled to the body, the set of circuit card engagement pins for coupling with a circuit card connector and a set of PCB engagement pins for receiving contact pads of the PCB. Providing (702) an edge connector may be carried out by determining a range of movement distance between contact points of the set of PCB engagement pins and forming the set of PCB engagement pins to be capable of flexibly moving within that range.

The method of FIG. 7 includes coupling (704) the edge connector to the circuit card connector. Coupling (704) the edge connector to the circuit card connector may be carried out by inserting the edge connector into the circuit card connector such that the set of circuit card engagement pins of the edge connector flex inwards and outwards until contact regions of the set of circuit card engagement pins contact with contact regions within the circuit card connector.

The method of FIG. 7 includes inserting (706) the set of PCB engagement pins between contact pads of the PCB such that the contact points of the PCB engagement pins contacts the contact pads of the PCB. Inserting (706) the set of PCB engagement pins between contact pads of the PCB may be carried out by inserting the edge connector into the edge connector insertion cavity of the PCB.

Figure 8:
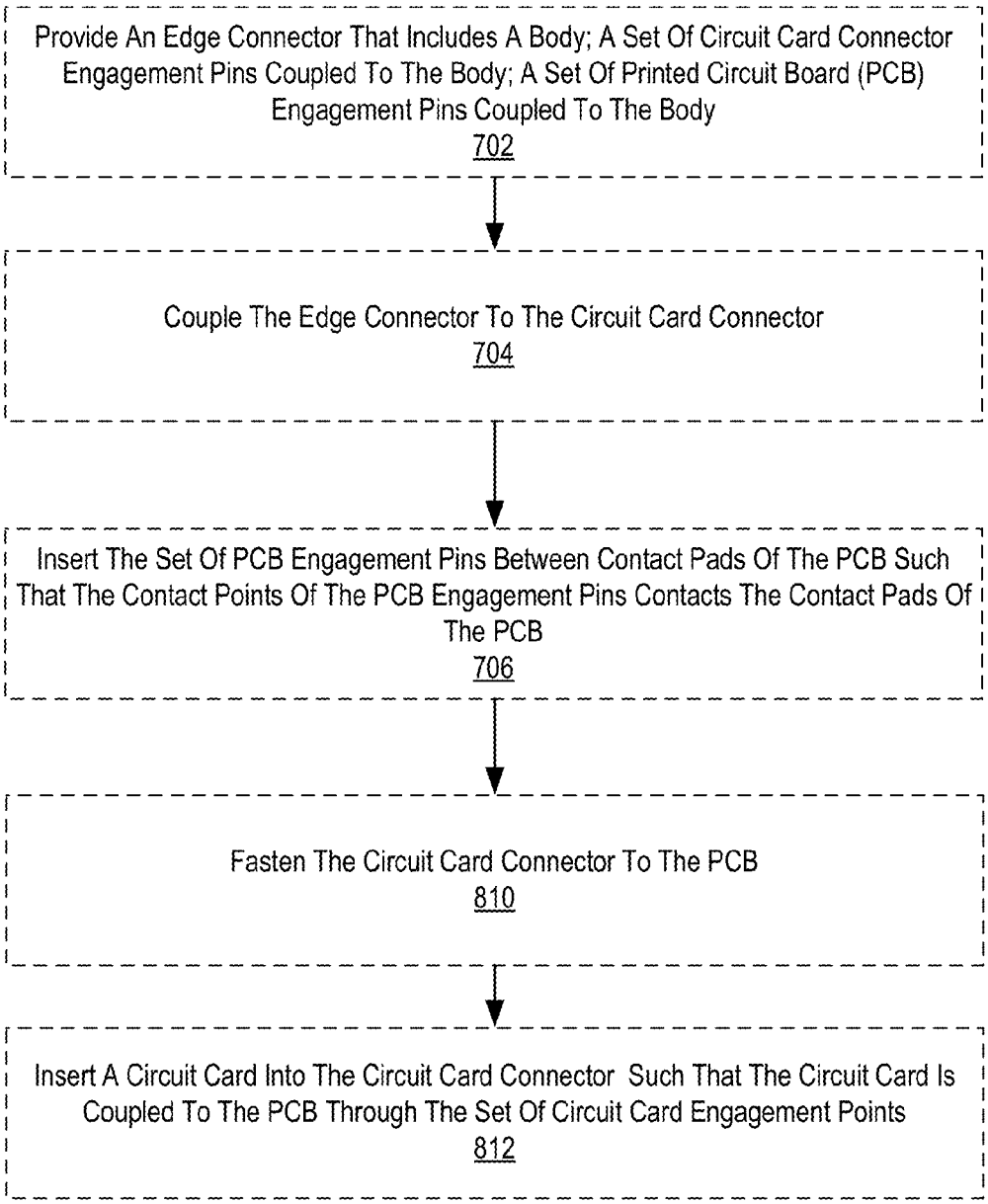
FIG. 8 sets forth a flow chart illustrating another exemplary method of attaching a circuit card connector to a printed circuit board using an edge connector that accommodates printed circuit boards of varying thickness according to embodiments of the present invention.

FIG. 8 sets forth a flow chart illustrating another exemplary method of attaching a circuit card connector using an edge connector that accommodates printed circuit boards of varying thickness according to embodiments of the present invention. The method of FIG. 8 includes the following elements of the method of FIG. 7: providing (702) an edge connector that includes a body, a set of circuit card engagement pins, and a set of PCB engagement pins; coupling (704) the edge connector to s circuit card connector; inserting (706) the set of PCB engagement pins between contact pads of the PCB such that the contact points of the PCB engagement pins contacts the contact pads of the PCB.

However, the method of FIG. 8 also includes fastening (810) the circuit card connector to the printed circuit board (PCB). Fastening (810) the circuit card connector to the PCB may be carried out by threading a screw through a hole within the circuit card connector and into the PCB.

The method of FIG. 8 also includes inserting (812) a circuit card into the circuit card connector such that the circuit card is connected to the PCB through the set of circuit card engagement pins. Inserting (812) the circuit card into the circuit card connector may be carried out by establishing a conductive pathway between the contact regions on the circuit card and conductive traces or pathways on the circuit card connector.

It will be understood from the foregoing description that modifications and changes may be made in various embodiments of the present invention without departing from its true spirit. The descriptions in this specification are for purposes of illustration only and are not to be construed in a limiting sense. The scope of the present invention is limited only by the language of the following claims.

What is claimed is:

1. An edge connector that accommodates printed circuit boards (PCB) of varying thicknesses, the edge connector comprising:

a body;

a set of card connector engagement pins coupled to the body, the set of card connector engagement pins that couple with a circuit card connector; and a set of PCB engagement pins coupled to the body, the set of PCB engagement pins receiving contact pads of a PCB, wherein each PCB engagement pin includes a contact point that slopes away from the body of the edge connector, wherein the contact point of each PCB engagement pin slopes in an opposite direction from the contact point of the other PCB engagement pin in the set, wherein each PCB engagement pin is flexible inward toward the body of the edge connector.

2. The edge connector of claim 1, wherein the contact point of the edge connector engages a contact pad of the PCB when the edge connector is mated to the PCB.

3. The edge connector of claim 1 includes wherein each PCB engagement pin is attached to the same side of the body of the edge connector.

4. The edge connector of claim 1, wherein each PCB engagement pin is attached to an opposite side of the body of the edge connector.

5. The edge connector of claim 1, wherein each circuit card engagement pin includes a contact region that slopes inwards towards the other circuit card engagement pin in the set.

6. The edge connector of claim 1, wherein each circuit card engagement pin includes a lead-in surface and a contact region, the contact region of the circuit card engagement pin that contact with the circuit card connector.

7. The edge connector of claim 6, wherein the direction of slope of the contact points of the PCB engagement pins is substantially perpendicular to the direction of slope of the contact region of the circuit card engagement pins.

8. A method of attaching a circuit card connector using an edge connector that accommodates printed circuit boards (PCB) of varying thickness, the method comprising:

providing the edge connector that includes a body; a set of circuit card engagement pins coupled to the body; a set of PCB engagement pins, the set of circuit card engagement pins coupling with a circuit card connector; the set of PCB engagement pins receiving contact pads of a PCB, wherein each PCB engagement pin includes a contact point that slopes away from the body of the edge connector, wherein the contact point of each PCB engagement pin slopes in an opposite direction from the contact point of the other PCB engagement pin in the set, wherein each PCB engagement pin is flexible inward toward the body of the edge connector;

coupling the edge connector to the circuit card connector; and inserting the set of PCB engagement pins between contact pads of the PCB such that the contact points of the PCB engagement pins contacts the contact pads of the PCB.

9. The method of claim 8, wherein the contact point of the edge connector engages a contact pad of the PCB when the edge connector is mated to the PCB.

10. The method of claim 8, further comprising fastening the circuit card connector to the PCB.

11. The method of claim 8, further comprising inserting a circuit card into the circuit card connector such that the circuit card is connected to the PCB through the set of circuit card engagement pins.

12. The method of claim 8, wherein the circuit card connector is coupled to an edge of PCB, wherein the edge includes the contact pads of the PCB.

13. The method of claim 8, wherein the contact pads of the PCB are formed by post plate edge routing.

* * * * *